US006688794B1

(12) United States Patent
Hsu

(10) Patent No.: US 6,688,794 B1
(45) Date of Patent: Feb. 10, 2004

(54) AMUSEMENT PEN WITH TURNABLE DECORATION

(76) Inventor: Ming-Tay Hsu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/233,830

(22) Filed: Sep. 3, 2002

(51) Int. Cl.[7] ..... B43K 29/00; B43K 5/16

(52) U.S. Cl. ..... 401/195; 446/72; 446/146; 401/99

(58) Field of Search ..... 401/195, 52, 221, 401/243, 99; 446/71, 72, 146, 330, 331, 332, 359, 322

(56) References Cited

U.S. PATENT DOCUMENTS 5,186,562 A * 2/1993 Yoshinaga et al. ..... 401/112
5,433,642 A * 7/1995 Chia ..... 446/71
5,735,592 A * 4/1998 Shu ..... 362/118
6,254,298 B1 * 7/2001 Hsu ..... 401/195

* cited by examiner

*Primary Examiner*—David J. Walczak

(57) ABSTRACT

An amusement pen with a turnable decoration. A turnable device is formed by pulling wires, a U shape swingable rod and a decoration. By operating the pulling wires, the decoration will turn around the two pulling wires. A driven device has two linkages for winding the pulling wires. A driving active piece is buckled to the two linkages and an elastomer is located in the driven seat and above the driving active piece. A driving seat is formed by two seat covers. A guide groove serves for pivotally installing the driving active piece. The pen body is installed at a lower end of the driven seat. The pen body comprises a filler and a cover. By operating the two linkages, pulling wires will be tightened or released; and at the same time, the turnable device will turn around the rope sleeve.

8 Claims, 7 Drawing Sheets

AMUSEMENT PEN WITH TURNABLE DECORATION

FIELD OF THE INVENTION

The present invention relates to amusement pens, and particularly to an amusement pen with a turnable decoration.

BACKGROUND OF THE INVENTION

The prior art pens have only static effects, that is, the decoration on the pen is static with respect to the pens. However, the applicant of the present invention has invented several kinds of pens having amusement effects, such as those disclosed in U.S. Pat. No. 6,254,298, "Ballpoint pen stand decorated with movable funny ornament", U.S. Pat. No. 6,332,727, "Ballpoint pen stand decorated with twist dancing ornament", etc. The decorations disclosed in the former inventions are not so vivid and are driven through the fillers. The decorations in the latter invention are operated by hands. No decoration can be operated by both fillers and hands. Further, the decorations in the former patent moves upwards and downwards and the decorations in the latter patent rotate. No decoration can turn by the whole body.

SUMMARY OF THE INVENTION

Accordingly, the present invention provides an amusement pen with a turnable decoration which comprises a turnable device, a driven device, a driven seat and a pen body.

The turnable device is formed by pulling wires, a U shape swingable rod and a decoration. By operating the pulling wires, the decoration will turn around pulling wires.

The driven device has two linkages for winding the pulling wires; the driven device being formed by two linkages. A driving active piece is buckled to the two linkages; an elastomer in the driven seat and above the driving active piece.

The driving seat encloses and fixes the driven device and is formed by two seat covers. An internal of the driven seat has two pivotal shafts for pivotally installing the two linkages, and two lateral holes. A guide groove serve's for pivotally installing the driving active piece; and the driven seat has a left through hole and a right through hole.

A pen body is installed at a lower end of the driven seat. The pen body is formed by a filler, and a cover receiving the filler and being positioned below the pen body;

By the expanding and reducing of the two linkages, pulling wires will be tightened or released; at the same time, the turnable device will turn around the rope sleeve.

The various objects and advantages of the present invention will be more readily understood from the following detailed description when read in conjunction with the appended drawing.

DETAILED DESCRIPTION OF THE PREFERRED EMBODIMENTS

The present invention will be described in the following with preferred embodiments.

First Embodiments

Figure 1:
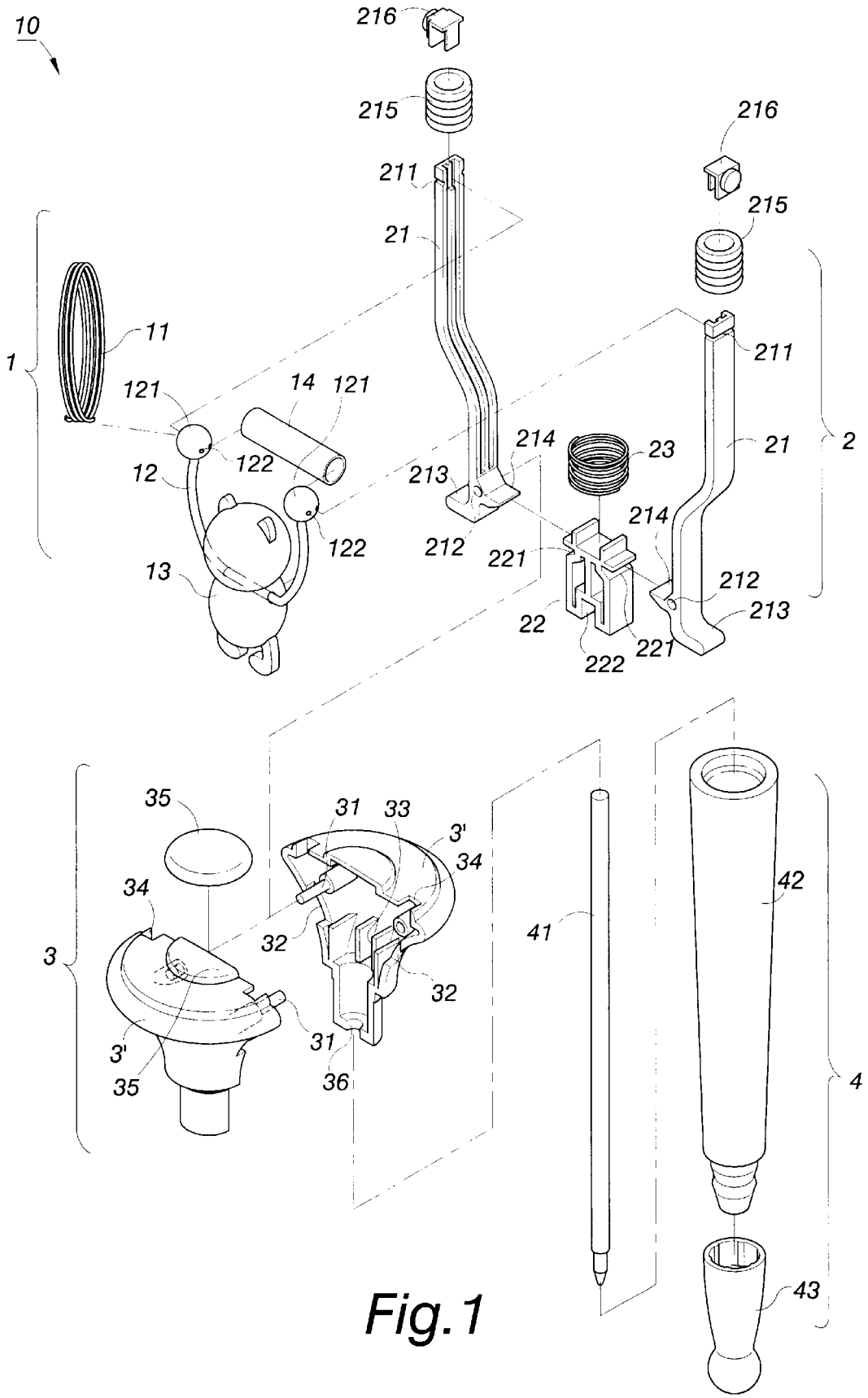
FIG. 1 is an exploded perspective view of the amusement pen with a turnable decoration of the present invention.
Figure 2:
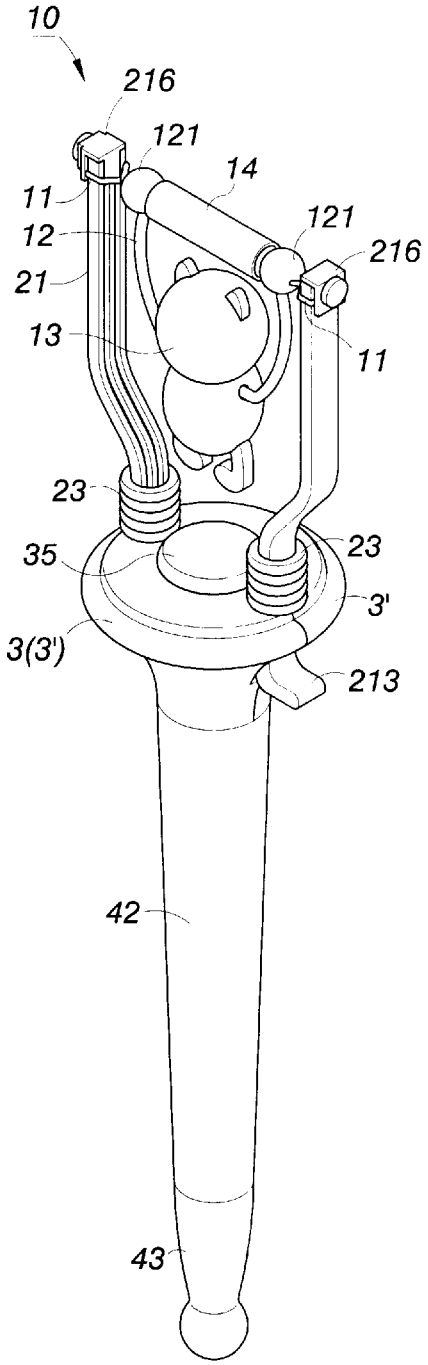
FIG. 2 is an assembled perspective view of the amusement pen with a turnable decoration of the present invention.

Referring to FIG. 1, the first embodiment about the amusement pen with a turnable decoration with a turnable decoration of the present invention is illustrated. It is illustrated that the turnable pen 10 of the present invention includes a turnable device 1, a driven device 2, a driven seat 3 and a pen body 4. The perspective view of the pen with turnable decorations according to first embodiment of the present invention is illustrated in FIG. 2.

Figure 3:
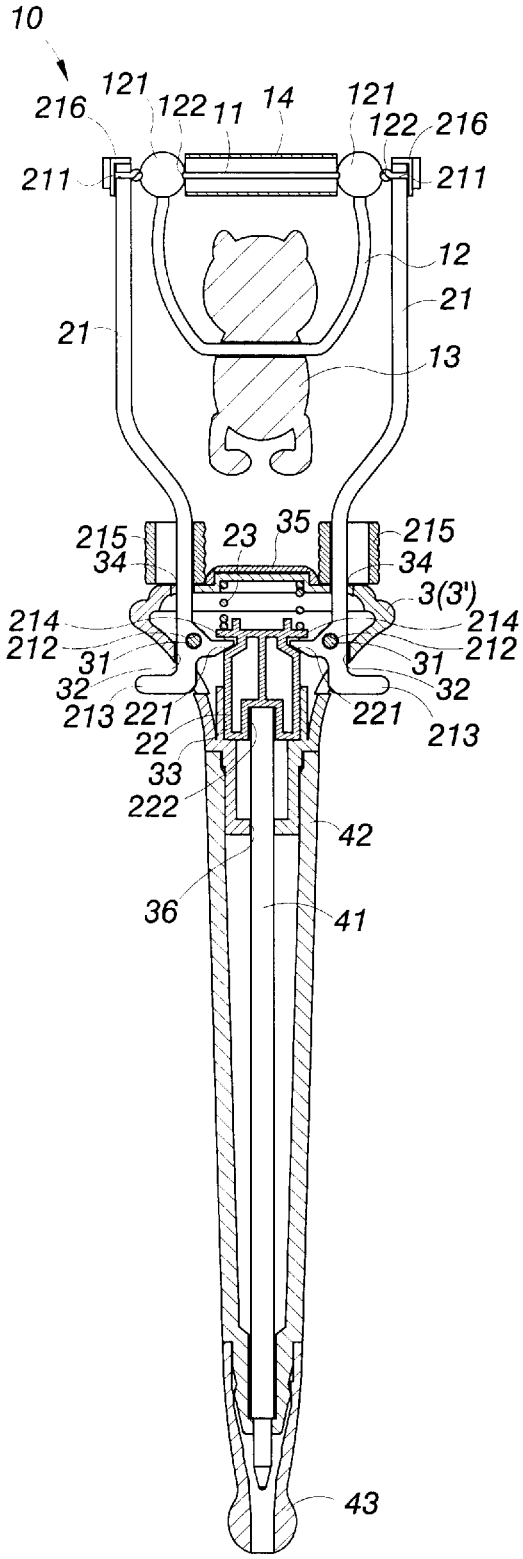
FIG. 3 is a cross sectional view of the amusement pen with a turnable decoration of the present invention.
Figure 7:
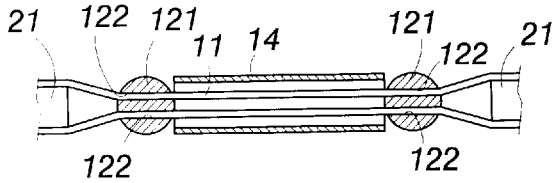

The details of the turnable device 1, driven device 2, driven seat 3 and the pen body 4 will be described herein with the reference of FIGS. 1 and 3. The cross sectional view of the pen with turnable decorations according to first embodiment of the present invention is illustrated in FIG. 3. The turnable device 1 is formed by parallel pulling wires 11, a U shape swingable rod 12, a decoration 13, and a rope sleeve 14. Each of two ends of the U shape swingable rod 12 has a swinging ball 121. Each swinging ball 121 has two opposite through holes 122. Thereby, the pulling wires 11 can pass through the swinging balls 121, as illustrated in FIG. 7. The parallel pulling wires 11 run across one another after passing through the swinging ball 121, and then the ends of the pulling wires 11 are fixed to the linkage 21. The U shape swingable rod 12 passes through and positioned above the body of the decoration 13. The decoration 13 is turnable around the rope sleeve 14. The details will be described hereinafter.

The driven device 2 is formed by two opposite linkages 21, a driving active piece 22 buckled to the two linkages 21, and an elastomer 23 installed to the driving active piece 22. An upper end of the linkage 21 has a line groove 211 for winding the pulling wire 11. A lower end of the linkage 21 has a pivotal hole 212 for being passed through by the pivotal shaft 31 of the driven seat 3. An outer side of the lower end of, the linkage 21 has a press 213 protruding out of a lateral hole 32 of the driven seat 3. An inner side of the lower end of the linkage 21 has a buckle 214 which inwardly protrudes from an inner side of the linkage (see FIG. 1) and is inserted into the buckling groove 221 of the driving active piece 22. Besides, at least one decorating cover 215 can pass over an upper end of the linkage 21. A top of the linkage 21 is installed with, a fixing buckle 216 for bucking the linkage 21. Moreover, the driving active piece 22 is guided into the guide groove 33 of the driven seat 3 and is confined by the guide groove 33. Thereby, the driving active piece 22 can be lifted or descended. Two lateral ends of the driving active piece 22 are formed with buckling grooves 221 for buckling the buckles 214 and thus the two buckles 214 and the driving active piece 22 can interact with one another. Furthermore, the elastomer 23 (for example, a spring) is installed between a top of the driven seat 3 and the driving active piece 22 for enforcing the driving active piece 22 to move downwards.

The driven seat 3 is formed by two opposite seat covers 3' and is fixed to an upper end of the pen body 4. The driven seat 3 includes a left and a right pivotal shafts 31, two lateral holes 32 and a guide groove 33. Moreover, a top end of the driven seat 3 has a left and a right through holes 34. The two linkages 21 can pass through the two through holes 34. An upper end of the pen body of the driven seat 3 has a fixing cover 35. After the two seat covers 3' are combined, they can be further fixed to the upper end of the pen body 4 (see FIG. 3).

The pen body 4 is formed by a filler 41, a pen tube 42 for installing the filler 41, and a cover 43 at the lower end of the pen tube 42. A top of the pen tube 42 can be connected to a lower end of the driven seat 3. A lower end of the driven seat 3 has a through hole 36. A top of the filler 41 passes through the through hole 36 and then is guided to move upwards and embedded into a positioning groove 222 at a lower end of the driving active piece 22.

Figure 4:
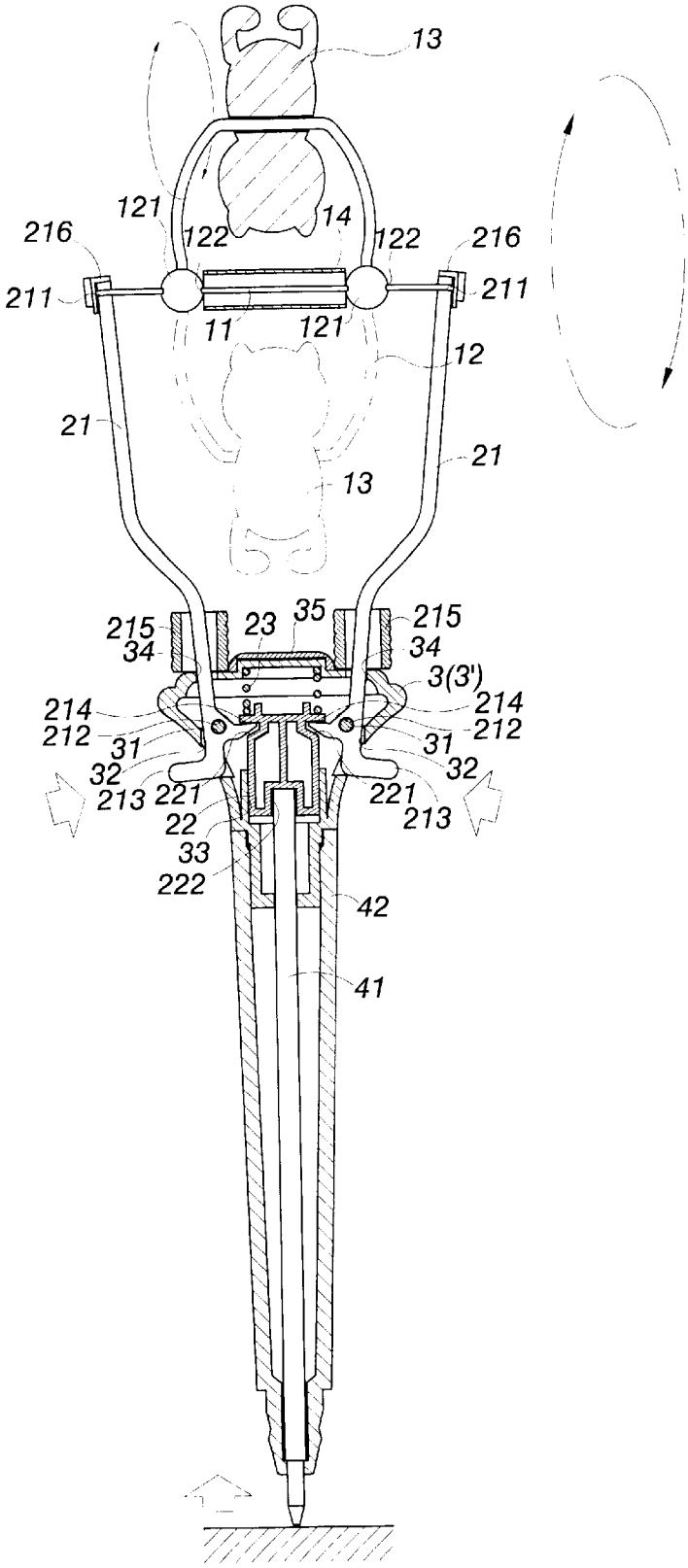
FIG. 4 is a schematic view showing the operation of the present invention.

Referring to FIG. 4, the turning operation of the decoration 13 of the pen of the present invention is illustrated. There are two ways for operating the pen.

First Way for Operating the Pen:

When the user applies a force to the left and right presses 213, the upper ends of linkages 21 will expand outwards around the pivotal shafts 31. The linkages 21 cause the pulling wires 11 to generate an outward tightening force. Then, the two buckles 214 at a lower end of the linkage 21 will shift upwards so that the driving active piece 22 is driven to displace upwards and then presses the elastomer 23. When the applied force is released, the elastomer 23 will release elastic force to enforce the driving active piece 22 to descend. Then the buckles 214 are driven to shift downwards. As a result, upper ends of the linkages 21 are reduced inwards to restore to the original state.

Second Way for Operating the Pen

When the user writes using one hand, a bottom of the filler 41 will move upwards due to a force applied thereto. Since an upper end of the filler 41 resists against the driving active piece 22, the driving active piece 22 will cause the driving active piece 22 to move within the guide groove to resist against the elastomer 23. The upper ends of the two linkages 21 will expand outwards so that the pulling wires 11 have outer tightening forces. However, when the pen tube 42 is lifted so that no force is applied to the filler 41, the elastomer 23 will release elastic force so that the driving active piece 22 descends and the upper ends of the two linkages 21 reduce inwards to restore to the original state.

Figure 5:
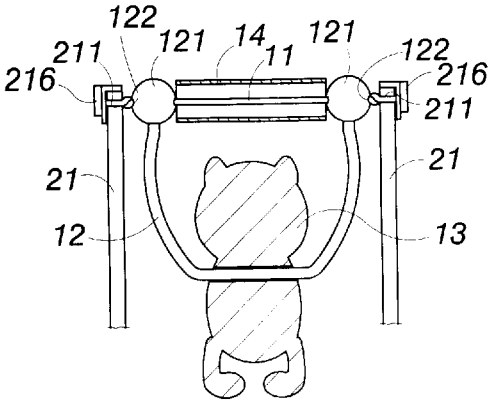
FIGS. 5 to 8 are schematic view showing the turning operation of the amusement pen with a turnable decoration according to the present invention.
Figure 6:
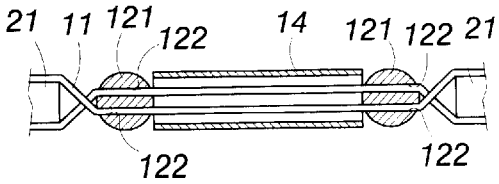
Figure 8:
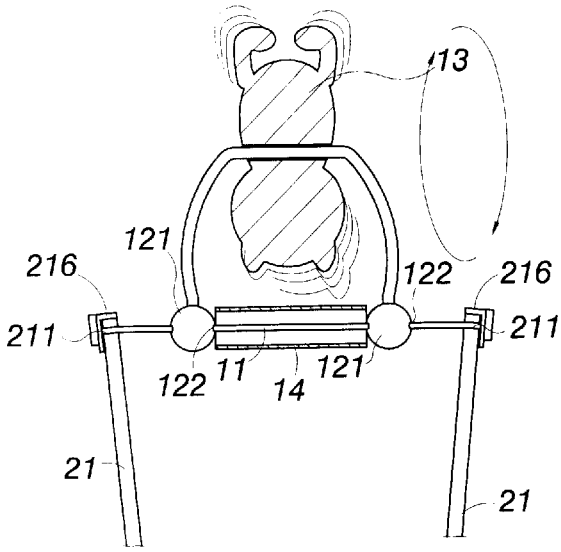

When the pulling wires 11 are tightly pulled and then released by the two linkages 21, the decoration 13 will turn. The principle of the turning operation will be described with reference to FIGS. 5 to 8. The decoration 13 suspends from the U shape swingable rod 12 naturally, see FIG. 5. The U shape swingable rod 12 will suspend from the pulling wires 11 due to the gravitation force. Then the two parallel pulling wires 11 will run across one another at the outer sides of the swinging balls 121 (referring to FIG. 6). When the two linkages 21 expand outwards, the pulling wires 11 become tighten, so that the pulling wires 11 do not run cross one another after the force is applied (referring to FIG. 7). Therefore, when the two pulling wires 11 return to non-crossing state from cross state, the two swinging bails 121 will turn through 180 degrees by the two through holes 122. Then the U shape swingable rod 12 connected by the swinging balls 121 will swing upwards, while the decoration 13 will turn with the swinging operation of the U shape swingable rod 12.

Second Embodiment

Figure 9:
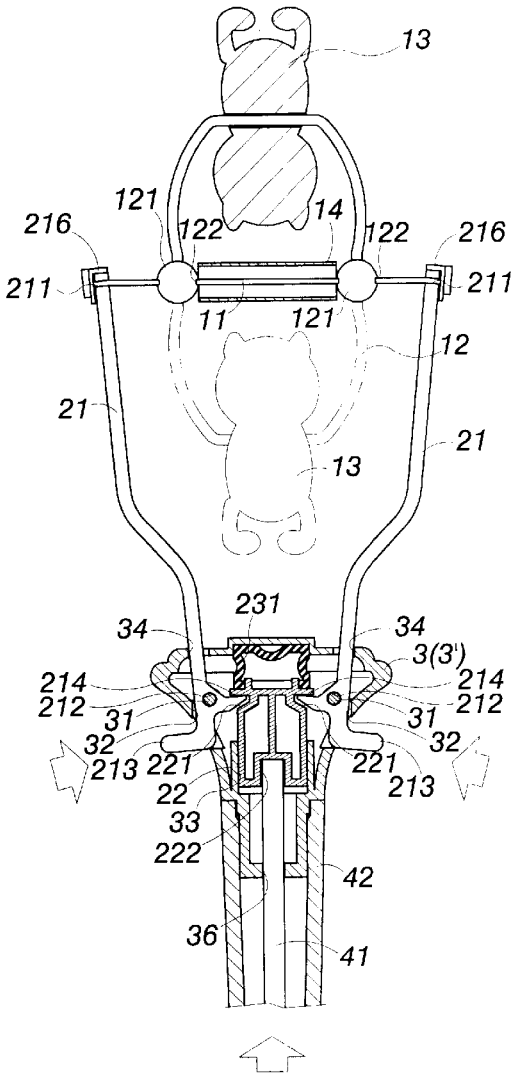
FIGS. 9 to 14 show other embodiments of the present invention.

Referring to FIG. 9, the difference of the present embodiment from the first embodiment is that the elastomer 23 is replaced by an elastic rubber block 231 which is a hollow rubber and has a preferred resilient force.

Third Embodiment

Figure 10:
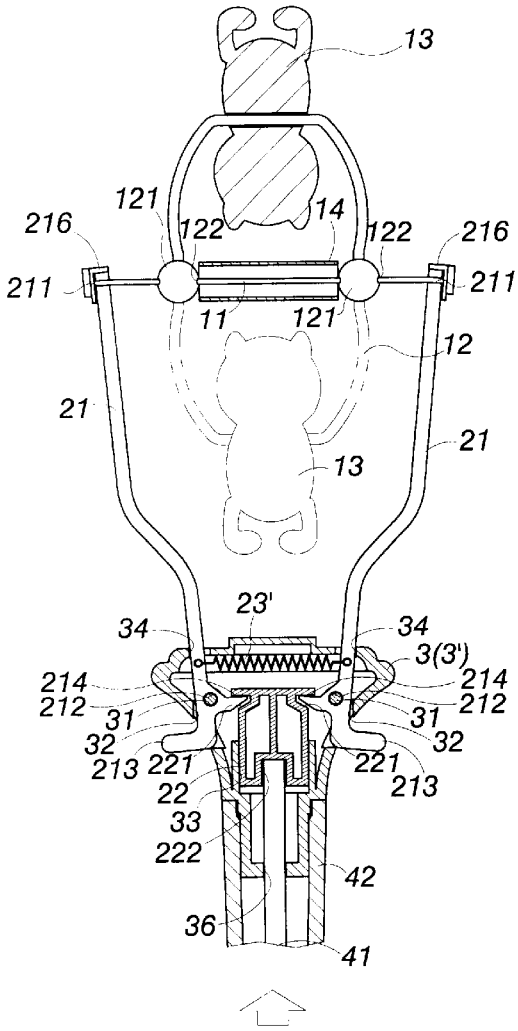

With reference to FIG. 10, the difference of this embodiment from the first embodiment is that the elastomer is replaced by a transversal reducible spring 23' which is positioned between the two linkages 21. Two ends thereof are buckled to the linkages 21. The buckling position thereof is above the pivotal hole 212 for providing restoring elastic forces to the linkages 21.

Fourth Embodiment

Figure 11:
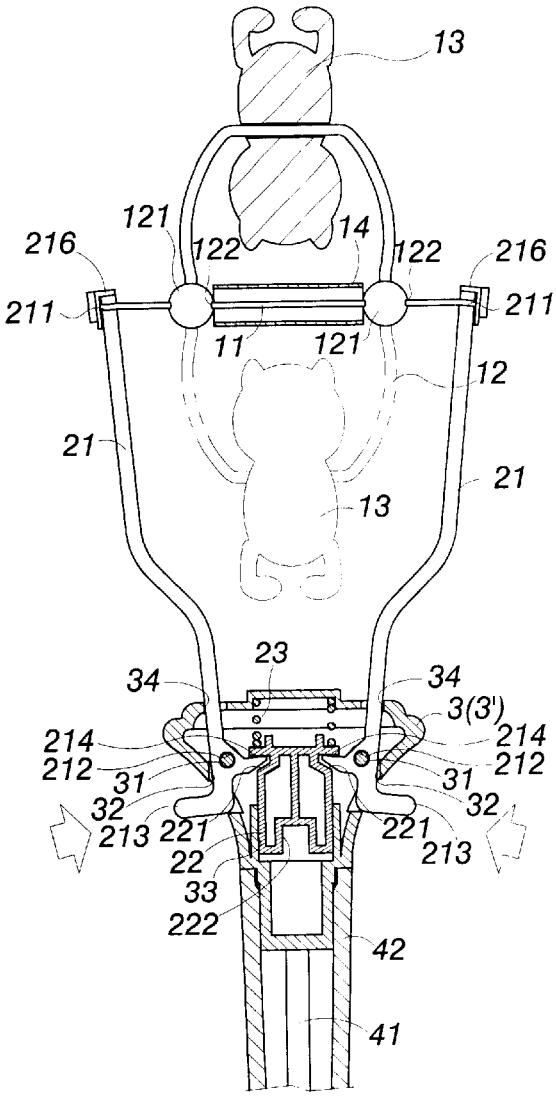

Referring to FIG. 11, the difference of this embodiment froth the first embodiment is that the bottom of the driven seat 3 is closed and no through hole is formed therein (referring to numeral 36 in FIG. 3). Thereby, no driving relation exists between the filler 41 of the pen body 4 and the driving active piece 22. Thereby, other then being used in general pen, the present invention can be used to telescopic pens, colored pens, ball pens, etc.

Fifth Embodiment

Figure 12:
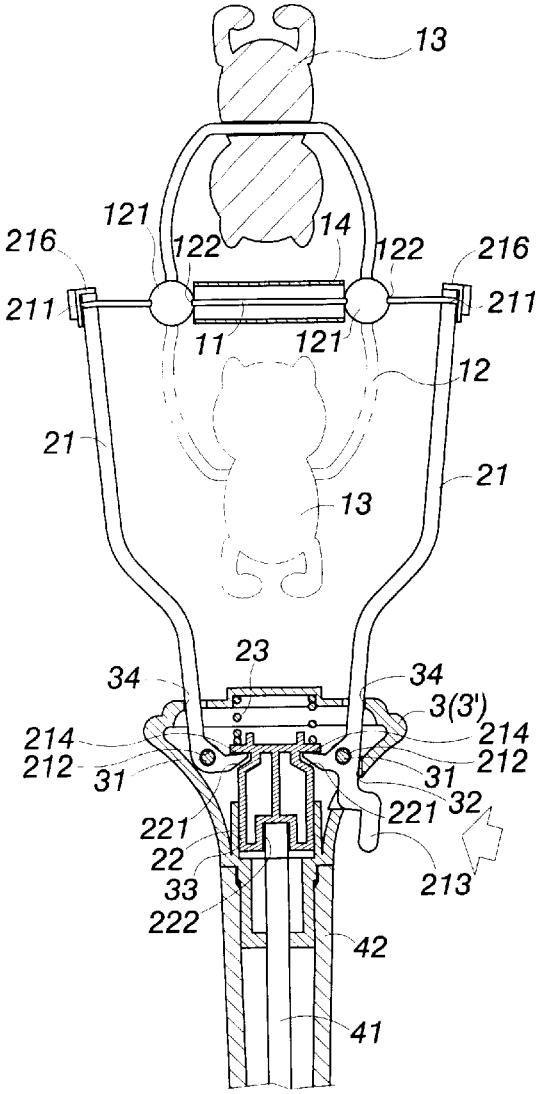

Referring to FIG. 12, the difference of this embodiment from the first embodiment is that a lower end of the linkage 21 has a press 213 which protrudes out of the lateral hole 32 of the driven seat 3, and a lower end of another linkage 21 has no press 213 to protrude out of the driven seat 3. Thereby, the user only operates the press 213 by one hand so as to turn the decoration 13.

Sixth Embodiment

Figure 13:
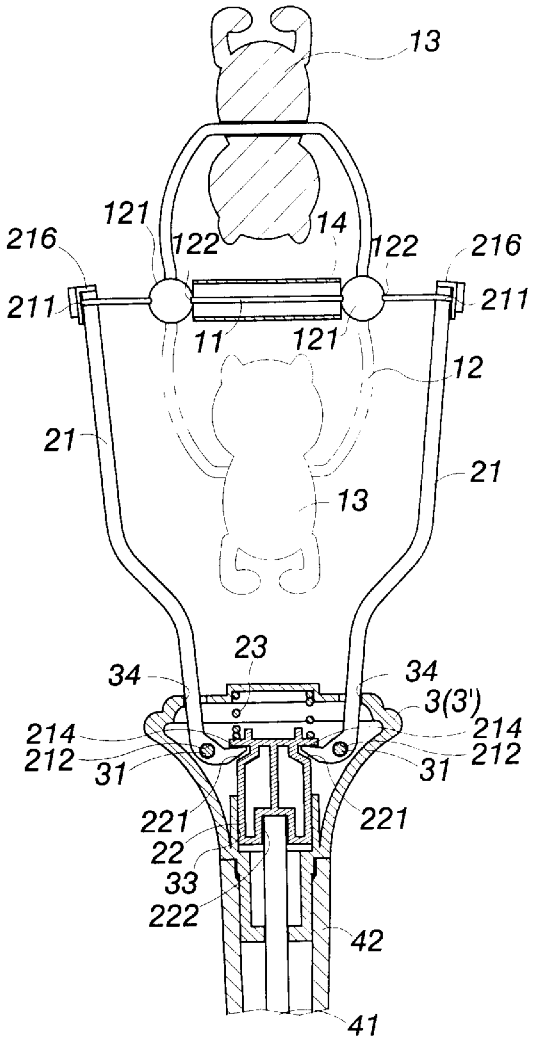

Referring to FIG. 13, the difference of this embodiment from the first embodiment is that each of the two linkages 21 has no press 213 which protrudes out of the lateral hole 32 of the driven seat 3. In writing, the filler 41 resists upwards against the driving active piece 22 to turn the decoration 13.

Seven Embodiment

Figure 14:
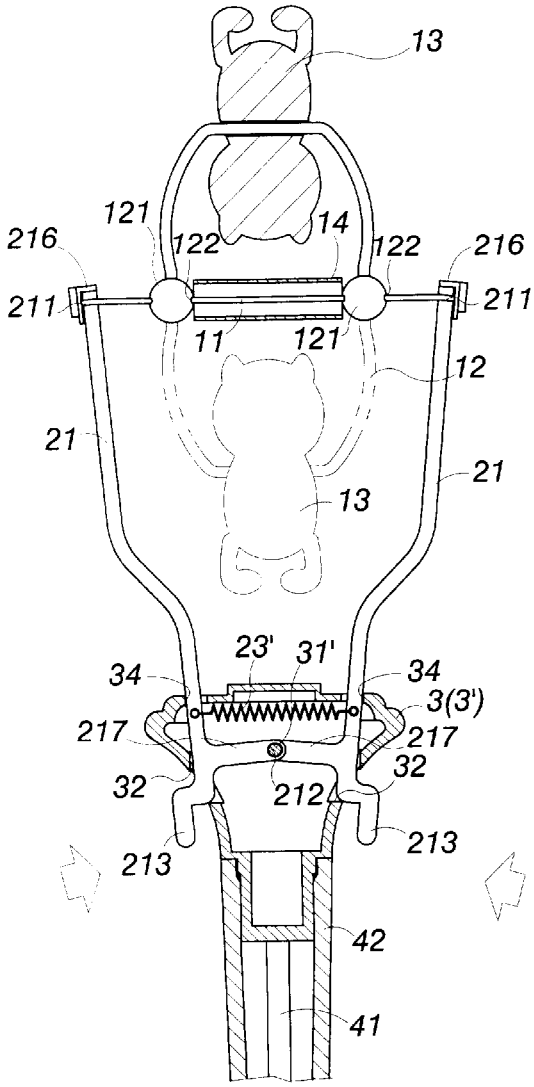

Referring to FIG. 14, the difference of this embodiment to the first embodiment is that the long buckles 217 at inner walls of the lower ends of the two linkages 21 are pivoted to the same pivotal shaft 31' at the center of the driven seat 3. The elastomer 23 is a transversal reducible spring 23'. Two ends thereof are buckled to the linkages 21. The buckling position is at the upper position of the pivotal holes 212. The lower end of the driven seat 3 is closed and no through hole. Thereby, the filler 41 is not driven by the driving active piece 22.

Advantages of the present invention will be described here:

4. The present invention has decorating and amusement effects.
5. The decoration is movable and is attractive.
6. By writing or playing the pen, the decoration turns around the pulling wires without any electric power and thus no battery is necessary.

What is claimed is:

1. An amusement pen with a turnable decoration comprising:

a turnable device 1 formed by pulling wires 11, a U shape swingable rod 12 and a decoration 13; by operating the pulling wires 12, the decoration 13 will turn around the pulling wires 12;

a driven device 2 being formed by two linkages 21; a driving active piece 22 buckled to the two linkages 21; and an elastomer 23 above the driving active piece 22; the two linkages serving for winding the pulling wires;

a driving seat 3 for fixing the driven device 2 and being formed by two seat covers 3'; the elastomer 23 being located within the driving seat, an internal of the driving seat 3 having two pivotal shafts 31 for pivotally installing the two linkages 21, and two lateral holes 32; a guide groove 33 for installing the driving active piece 22; and the driving seat having a left through hole 36 and a right through hole 35; and a pen body 4 installed at a lower end of the driving seat 3; the pen body 4 being formed by a filler 41, a cover 43 receiving the filler and being positioned below the pen body 4;

wherein by operating the two linkages 21, the pulling wires 11 will be tightened or released; at the same time, the turnable device will turn around the pulling wire 11.

2. The amusement pen with a turnable decoration as claimed in claim 1, wherein each of two ends of the U shape swingable rod 12 of the turnable device 1 has a swinging ball 121; each swinging ball 121 has two through holes 122 extending therethrough; pulling wires 11 pass through the through holes 122 in parallel and thus the two pulling wires 11 pass through the two swinging balls 121; after passing through the swinging balls 121, the two pulling wires 11 run cross one another and then are connected to the linkages 21; and a lower end of the U shape swingable rod 12 is installed with the decoration.

3. The amusement pen with a turnable decoration as claimed in claim 1, wherein the two linkages 21 of the driven device 2 are pivotally installed to the two pivotal shafts 31; a lower end of each linkage 21 has a protruded press 213 which protrudes from the lateral hole 32 of the driving seat 2 and an inward protruded buckle 214 which is buckled into a buckling groove; and the driving active piece 22 is installed to the guide groove 33 of the driving seat 3 and is confined therein.

4. The amusement pen with a turnable decoration as claimed in claim 3, wherein a lower end of the driven seat has a through hole, the filler of the pen body passes through the through hole and a top of the filler resists against the driving active piece.

5. The amusement pen with a turnable decoration as claimed in claim 1, wherein the elastomer is an expandable spring which is installed below a top of the driving seat and an upper end of the driving active piece for resisting against the driving active piece.

6. The amusement pen with a turnable decoration as claimed in claim 1, wherein the elastomer is a reducible spring which is installed in the driving seat and between two linkages; two ends of the reducible spring are buckled to the linkages.

7. The amusement pen with a turnable decoration as claimed in claim 1, wherein the elastomer is an elastic rubber block which is installed below a top of the driving seat and an upper end of the driving active piece for resisting against the driving active piece.

8. The amusement pen with a turnable decoration as claimed in claim 1, wherein the two linkages are positioned at two ends of the pulling wires, and a lower end of each linkage has an inward protruded buckle which is buckled into a buckling groove in the driving active piece; and the driving active piece is installed in the guide groove in the driving seat and is confined therein; a lower end of the driven seat has a through hole; the filler of the pen tube passes through the pen tube; and a top of the filler resists against the driving active piece.

* * * * *